US009568270B1

(12) United States Patent
LoRocco et al.

(10) Patent No.: US 9,568,270 B1
(45) Date of Patent: Feb. 14, 2017

(54) ARCHERY BOW STAND

(71) Applicant: TruGlo, Inc., Richardson, TX (US)

(72) Inventors: Paul LoRocco, Dallas, TX (US); John Estridge, Plano, TX (US); Damon Lamont Coalson, Dallas, TX (US); Gregory A. Webb, Garland, TX (US)

(73) Assignee: TruGlo, Inc., Richardson, TX (US)

( * ) Notice: Subject to any disclaimer, the term of this patent is extended or adjusted under 35 U.S.C. 154(b) by 0 days.

(21) Appl. No.: 14/866,450

(22) Filed: Sep. 25, 2015

(51) Int. Cl.

| | |
|---|---|
| ***F41C 27/00*** | (2006.01) |
| ***F41A 9/62*** | (2006.01) |
| ***F41A 29/00*** | (2006.01) |
| ***F41B 5/14*** | (2006.01) |

(52) U.S. Cl.
CPC ..... *F41B 5/14* (2013.01)

(58) Field of Classification Search
CPC ..... F41B 5/1453; F16M 11/242; F16M 11/32; F16M 11/26
USPC ..... 248/688, 163.1, 440.1, 188.7, 188.8, 248/351, 357, 150, 166, 168, 170, 169, 248/171, 173; 42/94; 124/86
See application file for complete search history.

(56) References Cited

U.S. PATENT DOCUMENTS

| | | | | |
|---|---|---|---|---|
| 1,128,248 | A * | 2/1915 | Hetzel | B05B 15/062 248/85 |
| 3,235,997 | A * | 2/1966 | Stoner | F41A 23/08 42/94 |
| 3,235,998 | A * | 2/1966 | Hadley | F41A 23/08 42/94 |
| 3,256,872 | A | 6/1966 | Koser | |
| 4,397,112 | A * | 8/1983 | York | F41A 23/08 42/94 |
| 5,106,044 | A * | 4/1992 | Regard, III | F41B 5/14 124/23.1 |
| D346,636 | S | 5/1994 | Bechtel | |
| D406,302 | S | 3/1999 | Simpson et al. | |
| 6,131,556 | A | 10/2000 | Villarreal | |
| 6,205,992 | B1 | 3/2001 | Meeks et al. | |
| 6,283,875 | B1 * | 9/2001 | Jones | A63B 55/10 211/70.2 |
| 6,957,648 | B1 * | 10/2005 | Adcock | F41B 5/1426 124/86 |
| 7,036,497 | B2 | 5/2006 | Horn | |

(Continued)

OTHER PUBLICATIONS

Sportsmans Warehouse Advertisement for V-Pod-Black-Folding-Bow-Kickstand Photo from website: http://www.sportsmanswarehouse.com. No date.

*Primary Examiner* — Terrell McKinnon
*Assistant Examiner* — Michael McDuffie
(74) *Attorney, Agent, or Firm* — Alvin R. Wirthlin

(57) ABSTRACT

An archery bow stand includes first and second legs having first and second connecting portions for engaging archery bow structure, and first and second support portions extending from the connecting portions for supporting the archery bow. The first and second legs are identical in construction and pivotally connected together. The first and second connecting portions together forming a hollow interior within which a biasing member is located to alternatively bias the legs toward the closed position and the open position. A pivot joint creates an internal gap so that the internal biasing member can travel across the pivot joint when the bow stand is opened and closed. Resilient overmolding on the legs protect the bow against damage when supported by the bow stand. Arcuate projections on each leg can be grasped by a user to facilitate opening and closing of the bow stand with one hand.

26 Claims, 7 Drawing Sheets

(56) References Cited

U.S. PATENT DOCUMENTS

| | | | | |
|---|---|---|---|---|
| 7,197,844 | B2 * | 4/2007 | Benson | F41A 23/08 248/593 |
| 7,314,199 | B1 * | 1/2008 | Ward | F41B 5/14 248/150 |
| 7,380,486 | B1 * | 6/2008 | Bean | F41A 23/08 42/94 |
| 8,596,597 | B1 * | 12/2013 | Spicer | F16M 11/38 15/230.11 |
| 8,882,070 | B2 * | 11/2014 | Bean | F41A 23/18 248/216.1 |
| 2003/0042388 | A1 * | 3/2003 | Peterson | F16M 11/20 248/440.1 |
| 2005/0188596 | A1 * | 9/2005 | Wygant | F41A 23/08 42/94 |

* cited by examiner 10
24
40
42
38
44
46
44
32
34
36
46
52
50
48
42
74
26
58
25
44
86
5
30
84
56
90
88
82
98
28
98
82
40
44
32
34
44
22
40
44
38
46
36
50
52
48
58
26
74
42
25
86
30
84
56
90
5
30
84
56
90
88
82
98
28
98
82
40
44
32
34
44
22
40
44
38
46
36
50
52
48
58
26
74
42
25
86

ARCHERY BOW STAND

BACKGROUND OF THE INVENTION

This invention relates generally to the field of archery, and more particularly to an archery bow stand for supporting a bow on the ground or other surface.

The necessity of being able to support an archery bow while at an archery range or during hunting has long been recognized. Prior archery bow stands widely vary in function and design, with the ultimate purpose of freeing the archer's hands while resting or when engaged in other activities where the archery bow is not needed. One particular type of bow stand that has grown in popularity is a scissor-type configuration where two arms are pivoted together, with one end of each arms functioning as the ground support and the opposite end of each arm serving to clamp around the limb of a bow. A tension spring extends between the arms and, because of its position with respect to the pivot point of the arms, positively holds the bow stand in an open position with the spring located below the pivot point, and positively holds the bow stand in a closed position with the spring shifted to a location above the pivot point as the arms are rotated. The exposed spring on these types of bow stands can be problematic, both to the user, and the user's equipment, which may be exposed to being pinched or scratched. Moreover, such bow stands are relatively low in cost and therefore do not provide protection for the surfaces with which they come in contact with, such as the limb of a bow. Since bow limbs operate under very high tensile and compression stresses, damage to the limbs caused by archery equipment, such as the scissor-type bow stand, can be problematic and eventually lead to degradation in bow performance and potentially compromise the safety of the archer when repeated damage occurs over time.

It would therefore be desirous to provide a bow stand that overcomes one or more disadvantages of the prior art.

SUMMARY OF THE INVENTION

In accordance with one aspect of the invention, a bow stand for connecting to opposite sides of a structure associated with an archery bow includes first and second legs having first and second connecting portions for contacting one side of the archery bow structure, and first and second support portions extending from the connecting portions for supporting the archery bow on a generally horizontal surface. The first and second legs are pivotally connected together for rotational movement between a closed position where the first and second connecting portions engage the opposite sides of the archery bow structure to support the archery bow on a generally horizontal surface, and an open position where the first and second connecting portions are disengaged from the archery bow structure. The first and second connecting portions together forming a hollow interior within which a biasing member is located. The biasing member is connected between the first and second connecting portions to alternatively bias the legs toward the closed position and the open position.

In accordance with yet a further aspect of the invention, a bow stand for connecting to opposite sides of a structure associated with an archery bow includes first and second legs having first and second connecting portions for contacting one side of the archery bow structure, and first and second support portions extending from the connecting portion for supporting the archery bow on a generally horizontal surface. The first and second legs are pivotally connected together for rotational movement between a closed position where the first and second connecting portions engage the opposite sides of the archery bow structure to support the archery bow on a generally horizontal surface, and an open position where the first and second connecting portions are disengaged from the archery bow structure. Each of the first and second connecting portions include a front connecting wall and a rear spaced from the front connecting wall. The first and second legs are pivotally connected together in reverse order such that the front connecting wall of the first leg abuts the rear connecting wall of the second leg to form a first pair of abutting walls, and the rear connecting wall of the first leg abuts the front connecting wall of the second leg to form a second pair of abutting walls.

In accordance with yet a further aspect of the invention, a bow stand for connecting to opposite sides of a structure associated with an archery bow includes first and second legs with respective first and second connecting portions adapted for contacting one side of the archery bow structure and respective first and second support portions for supporting the archery bow on a generally horizontal surface. The first and second legs are pivotally connected together for rotational movement between a closed and open positions. Each of the first and second connecting portions include a jaw section having a base segment, a side segment extending from the base segment, and a finger segment extending from the side segment so that the finger segment is cantilevered over the base segment to define an open gap therebetween for receiving the archery bow structure. A resilient clamp cover extends around inner surfaces of the base segment, the side wall segment, and the finger segment of the first and second legs. The resilient clamp cover can be integrally formed with the jaw section by overmolding.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict only typical embodiments of the invention and therefore should not be considered as limiting the scope thereof. It is further noted that the drawings may not be necessarily to scale. The invention will now be described in greater detail with reference to the accompanying drawings.

DETAILED DESCRIPTION OF THE INVENTION

Figure 1:
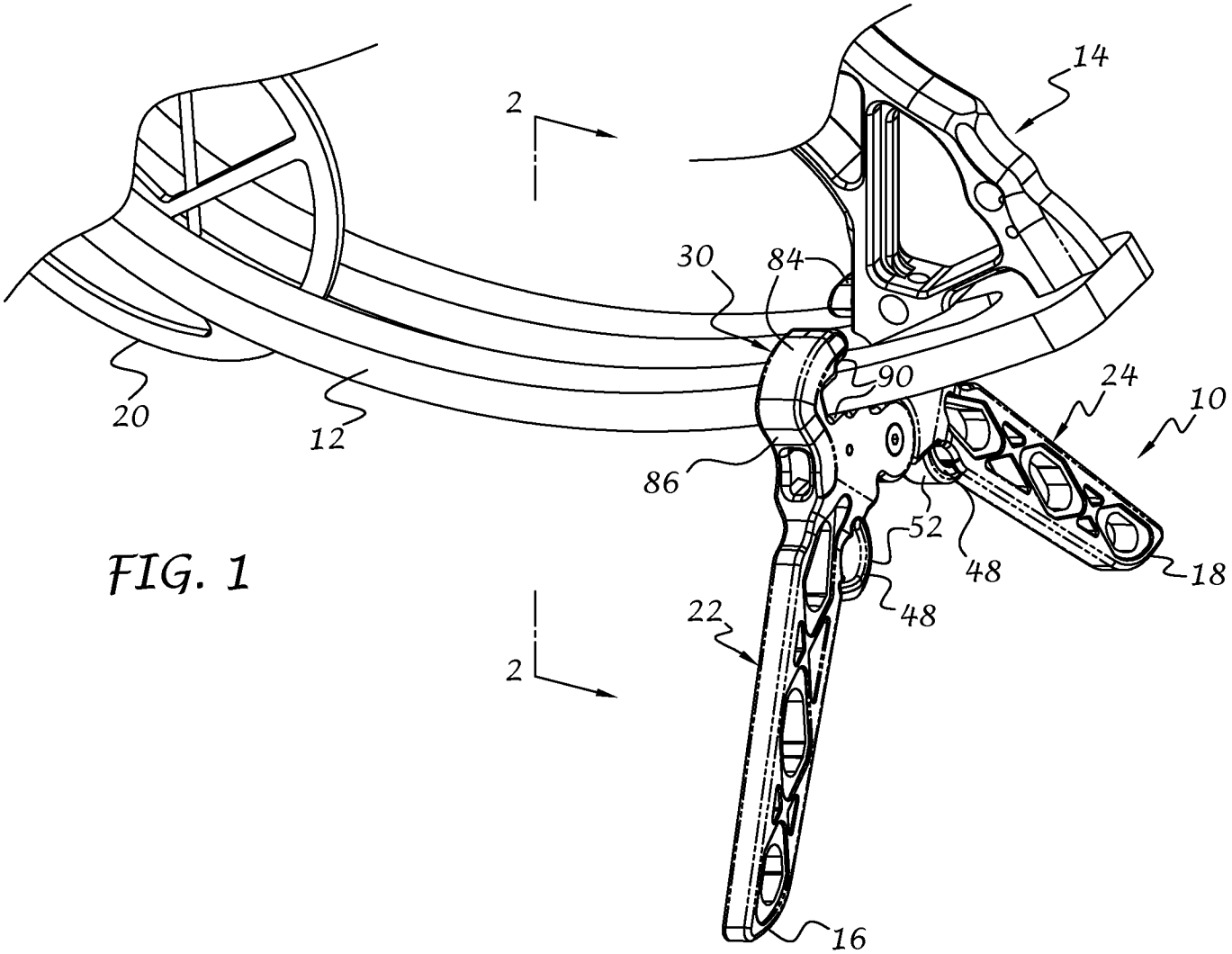
FIG. 1 is a rear perspective view of a bow stand in accordance with an exemplary embodiment of the invention connected to an archery bow.
Figure 2:
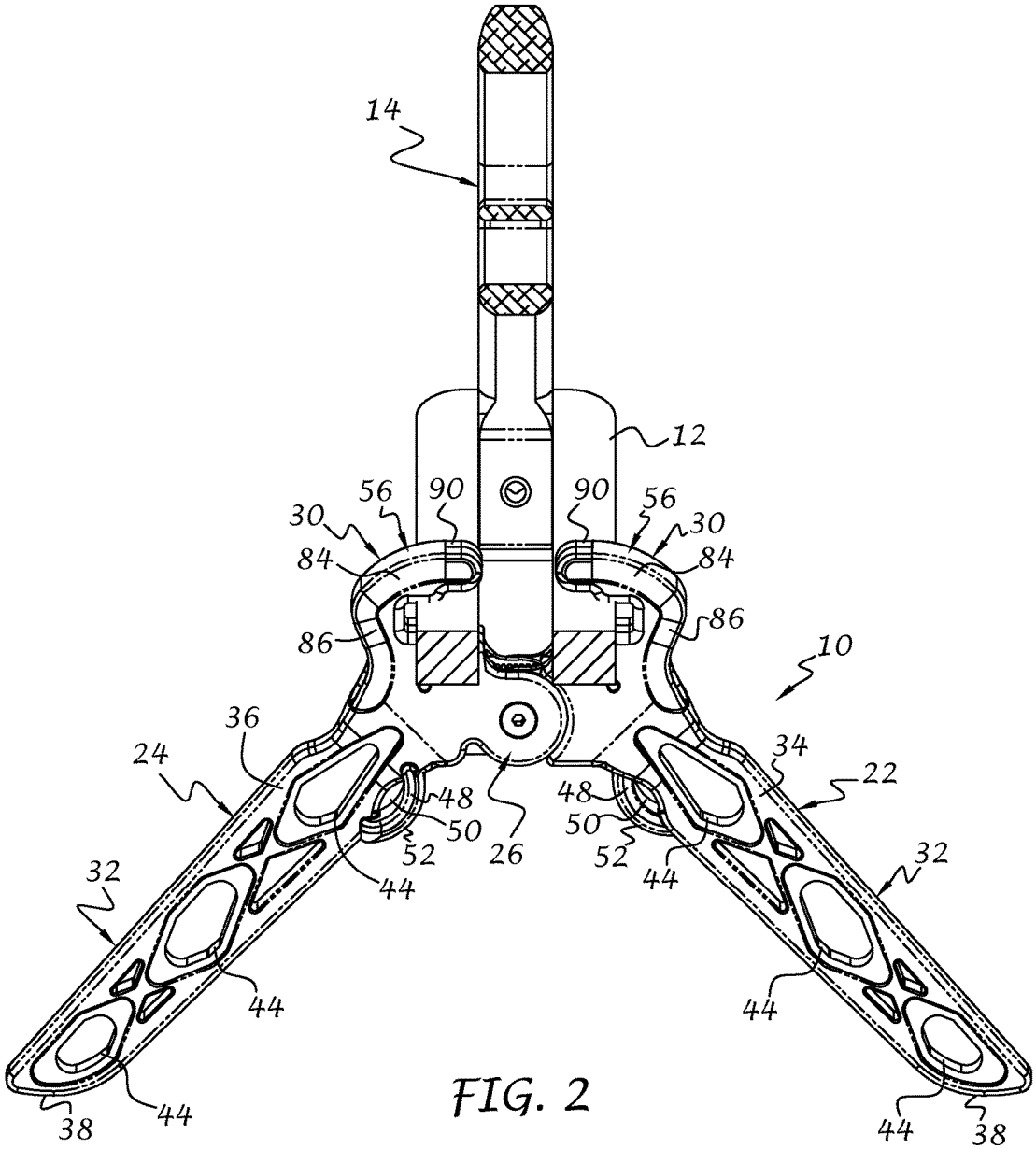
FIG. 2 is a front elevational view of the bow stand of FIG. 1 and sectional view of the archery bow taken along line 2-2 of FIG. 1 with the bow stand attached.
Figure 3:
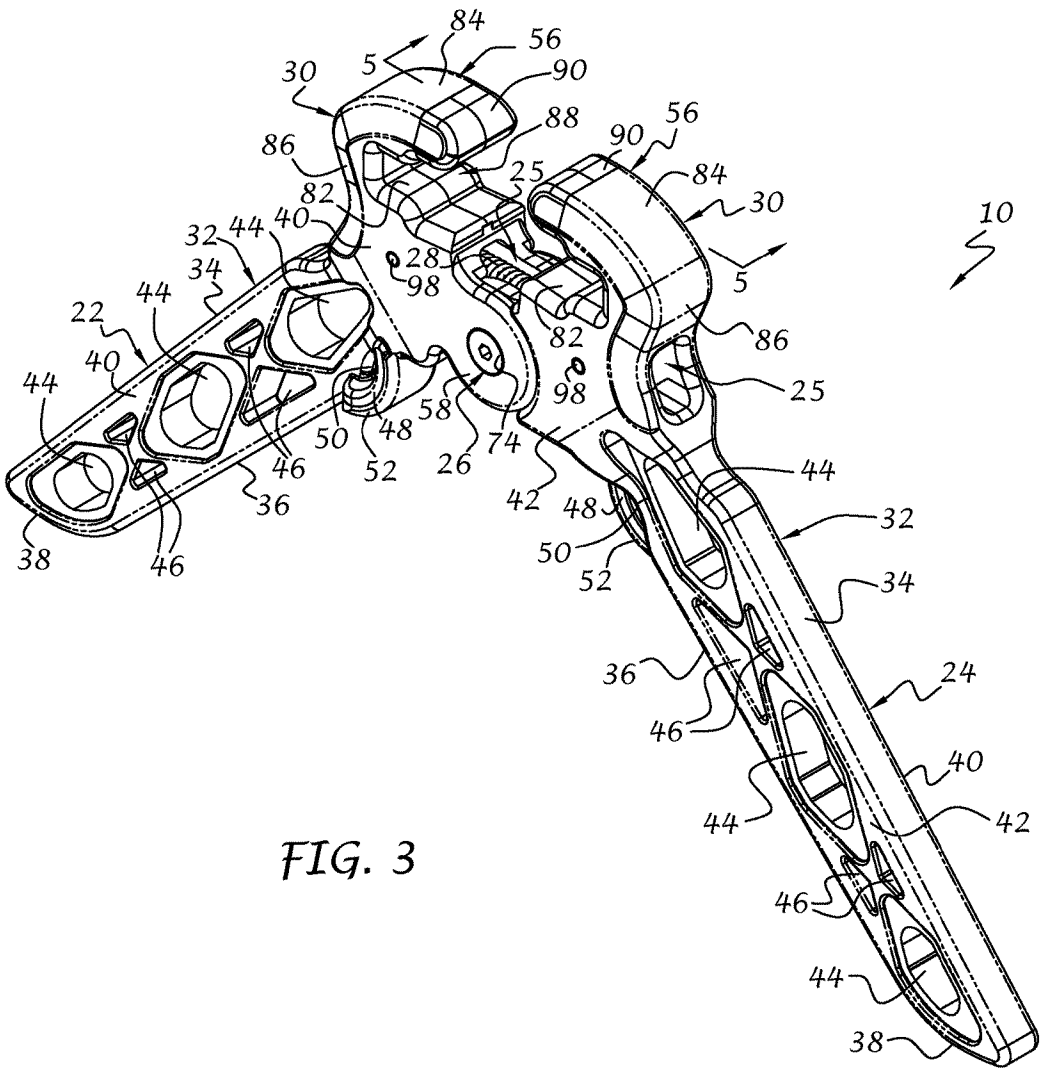
FIG. 3 is a front right isometric view of the archery bow stand in a closed position.
Figure 4:
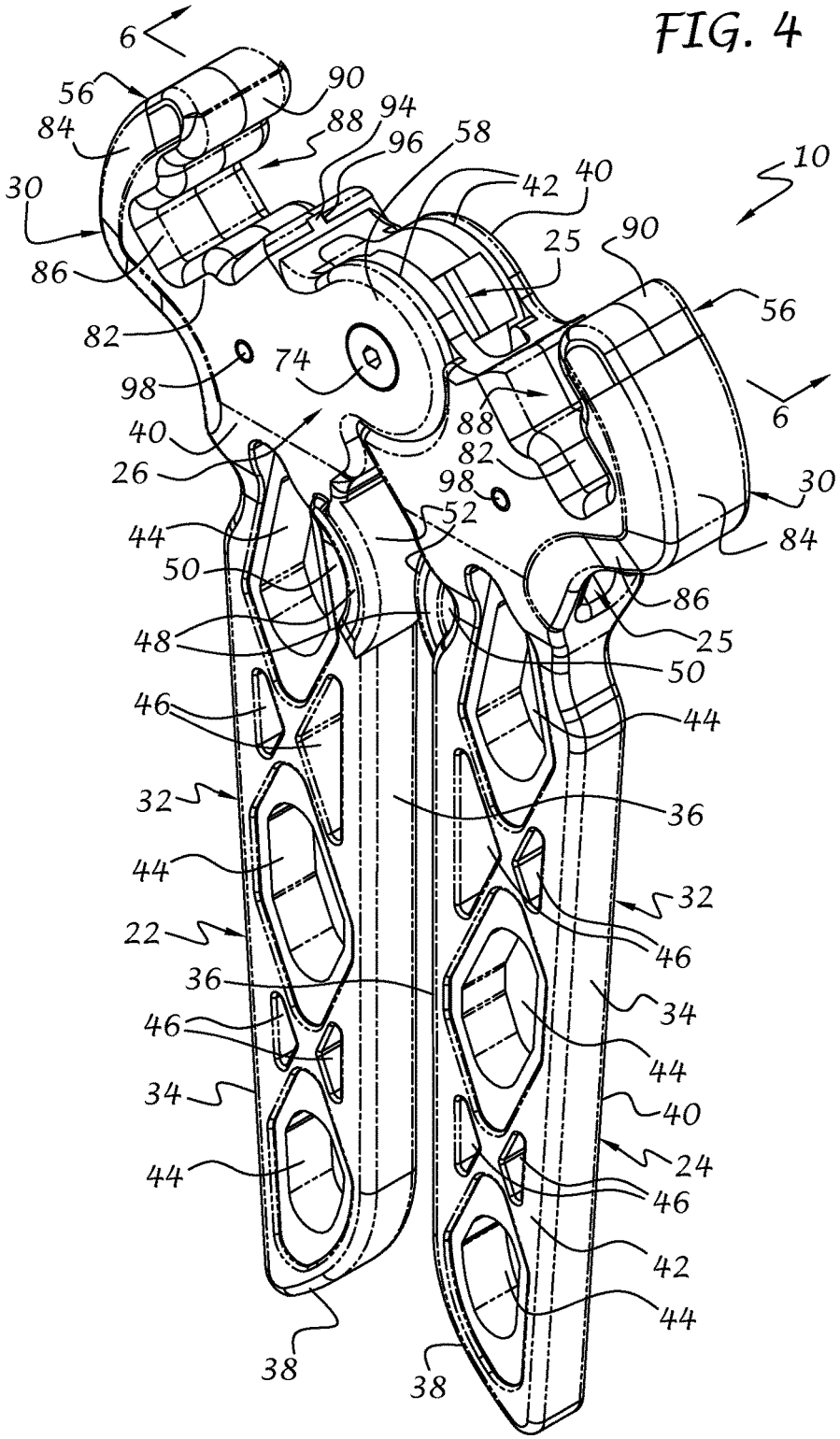
FIG. 4 is a view similar to FIG. 3 of the bow stand in an open, transportable position.

Referring now to the drawings, and to FIGS. 1 and 2 in particular, a bow stand 10 in accordance with an exemplary embodiment of the present invention is illustrated. The bow stand 10 is useful for attaching to the lower limb 12 of a bow 14, such as a compound bow, as shown, so that the bow stand 10 forms ground support areas 16 and 18 that, together with a ground support area 20 of the bow 14, such as the pulley, cam, or other bow portion, form a stable tripod support to hold the bow 14 in an upright position on the ground or other generally horizontal surface when at rest. Although the present invention is illustrated in conjunction with a compound bow 14, it will be understood that the bow stand 10 can be used with other types of archery bows, such as longbows, recurve bows, crossbows, and so on, as well as other firearms or devices where a bipod or tripod support may be desirable, without departing from the spirit and scope of the invention.

With additional reference to FIGS. 3-7, the bow stand 10 preferably includes a first leg 22 and a second leg 24 pivotally connected together via a pivot joint 26 for both attaching and detaching the bow stand 10 with respect to the bow 14 or other suitable structure when a bipod or tripod mount is desirable. A biasing member 28 is operably associated with the legs 22, 24 and the pivot joint 26 to alternatively bias the legs 22 toward and away from each other, as will be described in greater detail below.

The legs 22 and 24 are preferably identical in construction, and therefore like features are represented by like numerals on each leg. Each leg 22, 24 has a connecting portion 30 and a support portion 32 extending from the connecting portion. The combined connecting portions 30 of the legs 22 and 24 form a hollow interior 25 (FIGS. 3-5) for receiving the biasing member 28.

The support portion 32 is elongate in shape and includes an outer side wall 34, an inner side wall 36, a bottom support wall 38 extending between the outer and inner side walls, a front wall 40 and a spaced rear wall 42 bordered by the side walls and bottom support wall. Since the legs 22 and 24 are identical in construction, the front wall 40 of the first leg 22 and the front wall 40 of the second leg 24 face opposite directions when assembled. Accordingly, it will be understood that terms of orientation and/or position as used herein refer to relative, rather than absolute orientations and/or positions.

First openings 44 of various sizes and shapes extend through each leg 22 and 24 between the front and rear walls 40, 42 to reduce material requirements and its attendant costs, reducing the weight of the bow stand 10, allowing a user to easily grasp and manipulate the bow stand 10 during use, all while providing an aesthetically pleasing design. The first openings 44 are relatively large in size and are contrasted by second smaller openings 46 of various sizes and shapes that also extend between the front and rear walls 40, 42 to further reduce the amount of material and weight of the bow while providing an aesthetic pleasing design.

Figure 6:
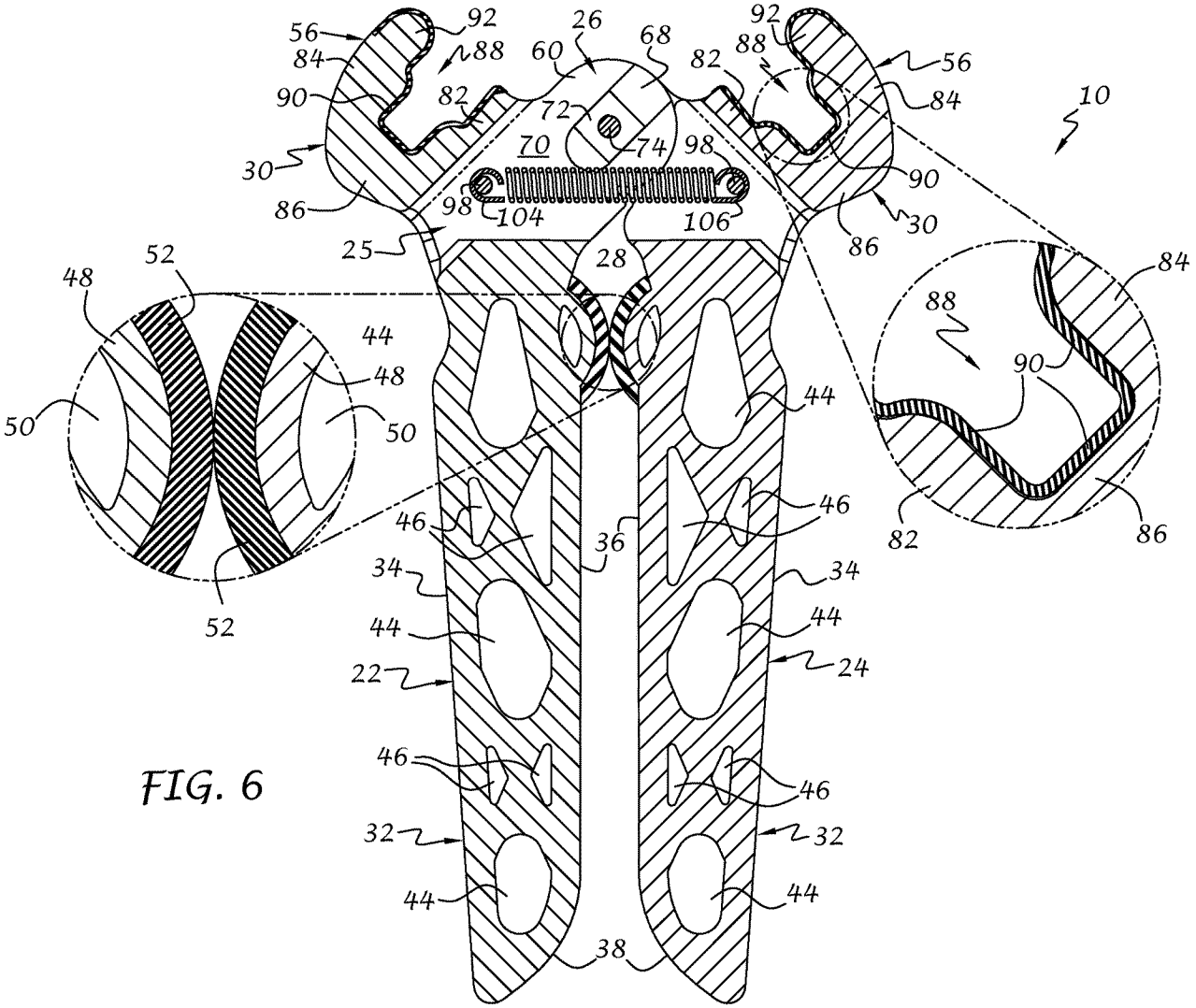
FIG. 6 is a sectional view of the open bow stand taken along line 6-6 of FIG. 4.

A bumper 48 extends inwardly from the inner side wall 36 of each leg 22, 24. The bumper 48 of each leg are in mutual contact when the bow stand 10 is in the open or disengaged position, as shown for example in FIGS. 4 and 6. The bumper 48 is formed as a convex protrusion of the inner side wall 36 and is of sufficient size to be in contact with the thumb and/or finger of a user when the bow stand 10 is opened or closed to thereby facilitate operation of the bow stand with one hand while holding the bow in the other hand. An opening or depression 50 can be formed in each leg 22, 24 adjacent to the bumper 48 so that the bumper can be more easily grasped by the user. As best shown in FIG. 6, a resilient bumper cover 52 extends over the bumper 48 of each leg 22, 24 to cushion and silence the legs 22, 24 when they are snapped toward the open position under biasing forces from the biasing member 28. The first resilient cover 52 can be formed as an overmolded component or can be formed separately and attached to the bumper 48 through adhesive bonding or other connecting means.

Although particular configuration of each leg 22, 24 is shown, it will be understood that each leg configuration can greatly vary without departing from the spirit and scope of the invention, including the various openings, as well as the leg size, shape, thickness, length, and so on. It will be further understood that each leg need not be identical as shown herein, but may have various dimensional, design, and functional features unique to the or each leg.

Figure 7:
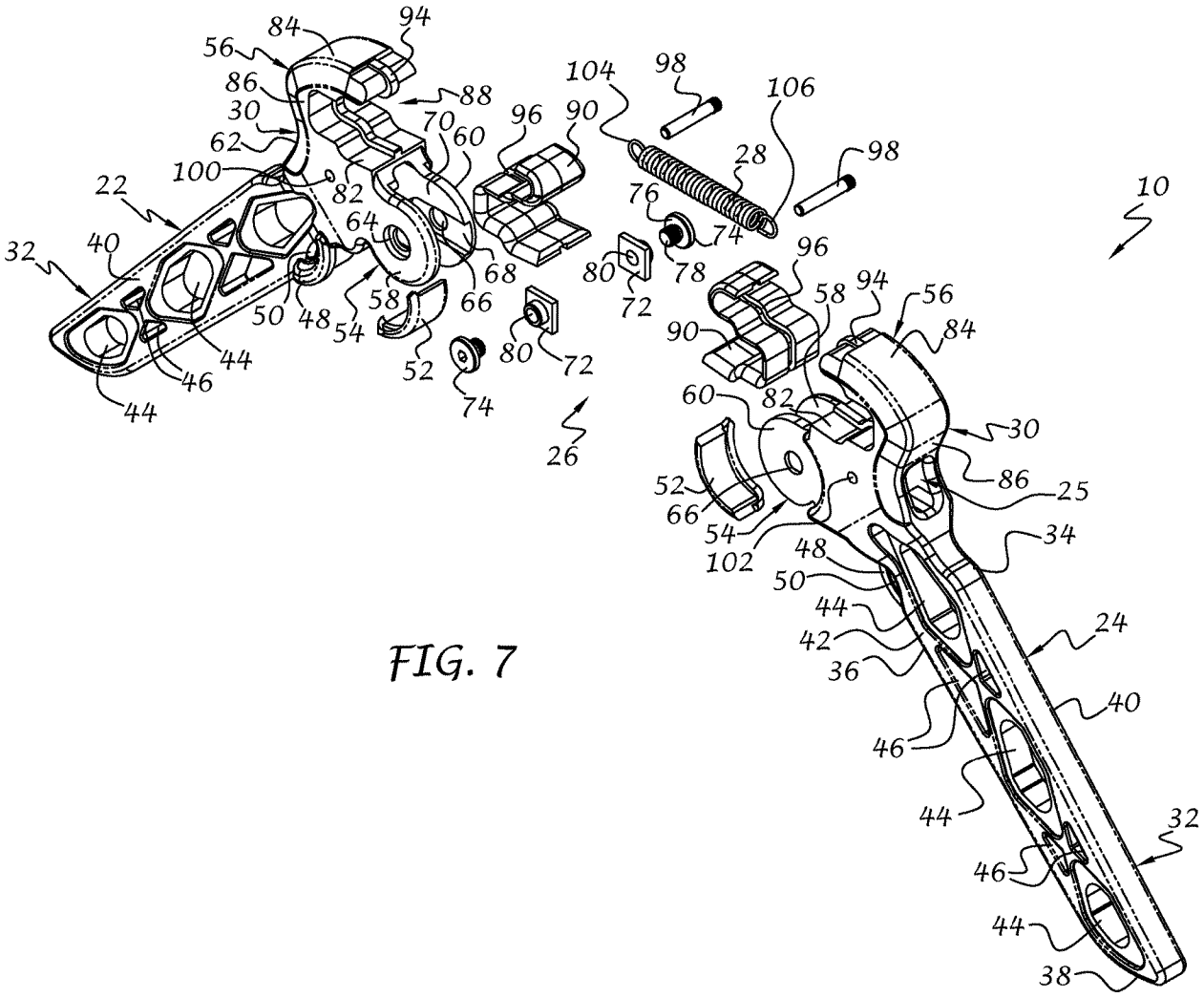
FIG. 7 is an exploded front right isometric view of the archery bow stand according to the invention.

The connecting portion 30 of each leg 22, 24 is preferably integrally formed with the support portion 32 and includes a pivot section 54 and a clamp or jaw section 56 extending upwardly from the pivot section. The pivot section 54 has a front pivot wall 58, a rear pivot wall 60, and a side wall 62 extending between the front and rear pivot walls. As best shown in FIG. 7, the front pivot wall 58 is preferably flush with the front wall 40 of the support portion 32, while the rear pivot wall 60 is recessed with respect to the rear wall 42 of the support portion 32 by an approximate thickness of the front pivot wall 58. In this manner, when the first and second legs 22, 24 are connected together, the front pivot wall 58 of the first leg 22 is located within the recessed rear pivot wall 60 of the second leg 24. Likewise, the front pivot wall 58 of the second leg 24 is located within the recessed rear wall 60 of the first leg 22. In this manner, the front pivot wall 58 of one leg 22, 24 is flush with the rear wall 42 of the support portion 32.

As shown in FIG. 7, the pivot joint 26 includes pivot openings 64 and 66 formed in the front and rear pivot walls 58 and 60, respectively, such that the pivot openings 64, 66 of the first leg are in alignment with the pivot openings of the second leg when connected together. The front and rear pivot walls are shown as generally circular in shape so that the legs 22, 24 can pivot freely between the open and closed positions of the bow stand 10. An inside slot 68 (see also FIGS. 5 and 6) is formed on the inside surface 70 of each pivot wall 58, 60 for receiving a square bearing nut 72, that is slid in alignment with the pivot openings 64, 66, with a threaded bearing portion 80 thereof extending through the openings during assembly. A fastener 74 has a head 76 recessed in the front wall 58 and a threaded shaft 78 that extends through the pivot openings 64, 66 and engages the threaded bearing portion 80 of the square nut 72 to thereby pivotally connect the first and second legs 22, 24 together so that the legs can pivot between open and closed positions. With this construction, a gap is formed in the hollow interior of the connecting portion to allow movement of the biasing member 28 past the pivot joint as the legs 22, 24 are rotated between the open and closed positions.

Figure 5:
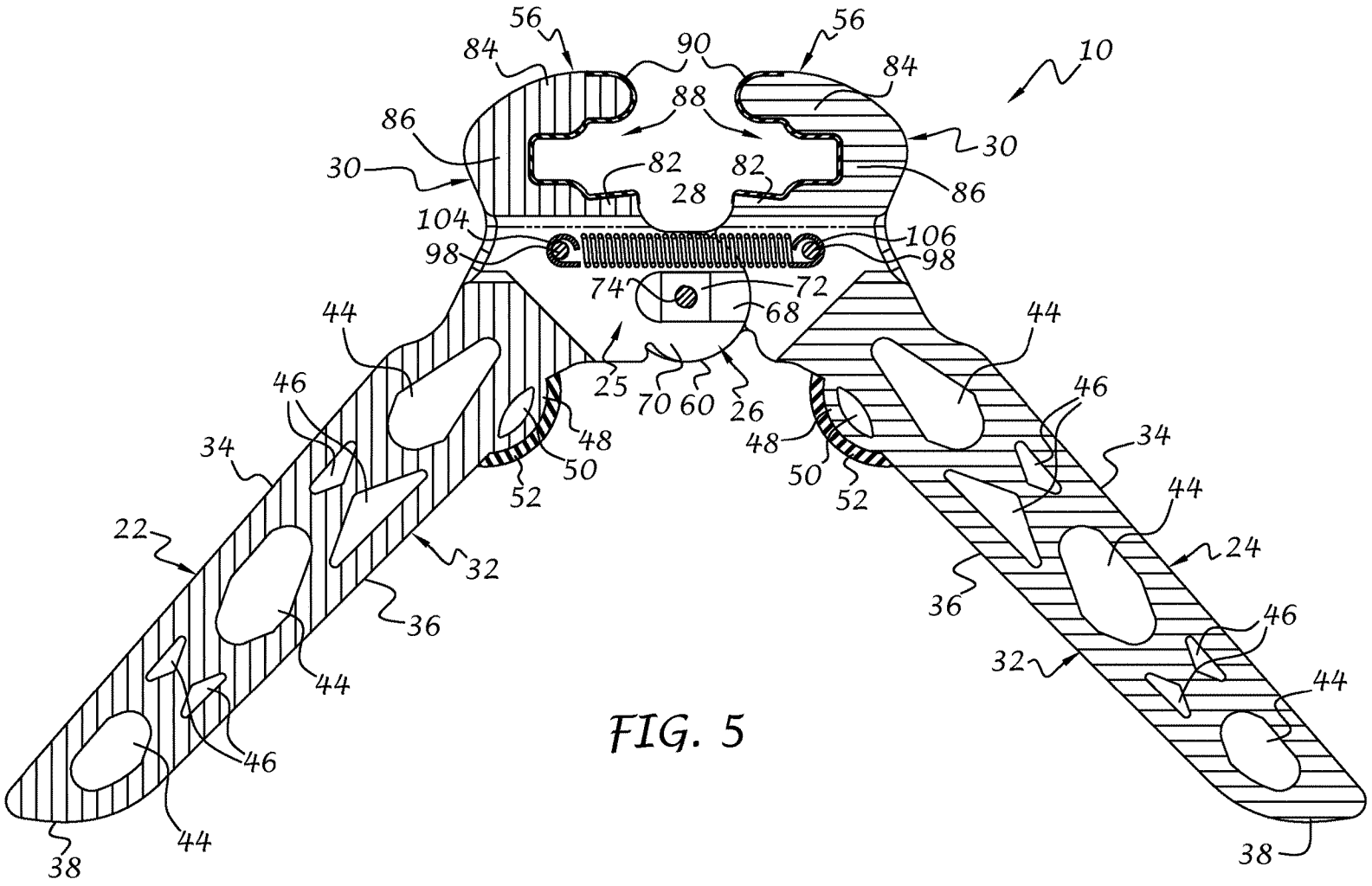
FIG. 5 is a sectional view of the closed bow stand taken along line 5-5 of FIG. 3.

As best shown in FIGS. 5-7, the clamp section 56 includes a C-shaped jaw section with a base segment 82 and a finger segment 84 extending parallel with the base segment. A side wall segment 86 extends between the base segment 82 and the finger segment 84 so that the finger segment is cantilevered over the base segment. An open stepped gap 88 is formed between the base segment 82 and the finger segment 84 for receiving the lower limb 12 of a bow 14 (FIGS. 1 and 2) for example, or other suitable structure for supporting the bow, crossbow, firearm or other device. A second resilient cover 90 extends around the inner surfaces of the base segment 82, side wall segment 86, and finger segment 84, and partially around a tip 92 of the finger segment. As shown in FIG. 7, a central elongate ridge 94 extends around the inner surfaces of the base segment, side wall segment and base segment. A corresponding elongate channel 96 is formed in the second resilient cover 90 to ensure that the cover is secured against movement with respect to the C-shaped jaw section. The second resilient cover 90 advantageously cushions the legs 22, 24 and silences any noise that would otherwise occur when the legs are snapped toward the closed position against the bow limb 12 or other structure under biasing forces from the biasing member 28. The resilient cover also protects the bow limb 12 or other structure from scratches and localized contact forces when the bow stand 10 is clamped therearound and positioned for properly holding the bow in a bipod or tripod support configuration, as previously described, and as shown in FIGS. 1 and 2. The second resilient cover 90 can be formed as an overmolded component or can be formed separately and attached to the C-shaped jaw section through adhesive bonding or other known connecting means.

With particular reference to FIGS. 5-7, the biasing member 28 preferably includes a coiled tension spring and stretches between the legs 22 and 24. Pins 98 extend through a first aperture 100 (FIG. 7) formed in the front wall 40 and a second aperture 102 formed in the rear wall 42 (FIG. 7) of the support portion 32 of each leg 22 and 24. The pins 98 can be secured to the legs through press-fitting, adhesive bonding, mechanical fastening, or other known connecting means. During assembly, the pins 98 are inserted through one of the apertures 100 or 102 and a coiled or looped end 104 and 106 of the spring 28 is positioned over the pins. The pins are then inserted through the other aperture 102 or 100 and secured to the legs to thereby retain the spring in position between the front wall 40 and rear wall 42 of the bow stand 10. With this arrangement, the spring 28 is located inside the hollow interior 108 of the bow stand 10, as defined by the front and rear walls thereof, and is therefore protected against damage, which may inadvertently occur when the spring is snagged or caught if fully exposed. Moreover, the isolated spring is no longer exposed as in the prior art to potentially cause damage to the bow or other objects, and also eliminates potential injury to a user that might otherwise occur with an exposed spring.

In use, as best shown in FIGS. 5 and 6, with the bow stand 10 initially in the open position, as shown in FIG. 6, the spring 28 is below the pivot joint 26, and is thus in a stable open position, in that it will not move to the closed position without the application of opposing forces on the legs 22 and 24. As the bow stand moves towards the closed position, the separate pivot connections of the pivot joint allow the spring 28 to travel past the pivot joint without interference. When the bow stand is in the closed position, as shown in FIG. 5, the spring 28 is above the pivot joint 26, and is thus in a stable closed position, in that it will not move to the open position without the application of an outside force on the legs 22 and 24.

When it is desirous to attach the bow stand 10 to the limb of a bow or other structure, one leg 22 or 24 can be grasped with one hand by a user and the thumb or finger of the user can grasp the bumper 48 of the other leg and pull the legs together to thereby move the bow stand 10 to the open position. Once the bow limb or other structure is aligned with the gaps 88 in the C-shaped jaw sections, the user can close the bow stand 10 with one hand by grasping the one leg 22 or 24 and pushing the other leg away using the thumb or one or more fingers to thereby move the bow stand 10 to the closed position where it is clamped around the bow structure.

In accordance with an exemplary method of constructing the bow stand 10, the legs 22 and 24 can be formed of any suitable material, such as plastic, via injection molding, or metal via machining, and so on, and then placed into an injection mold, and a second material, such as an elastomeric material, can be over-molded around the legs to form the cushioned portions of the bow stand 10. In this manner, the two materials are permanently joined together as an integral structure, and work together to produce a bow stand that is strong, light weight, and aesthetically pleasing, and practical to the purchaser or end user. Post processing of the combined two-part assembly can then be performed. Other retaining apertures or slots, besides those previously described, can also be formed in the legs and/or resilient material, and a corresponding number of retaining bumps or projections of complementary shape and size can be formed in the resilient material and/or the legs so that the more rigid structure and more flexible, resilient material are fixed together against relative slidable movement without the need for adhesives and extra assembly steps. During over-molding, the flexible material can flow into retaining grooves and around retaining projections or bumps to thereby create an integral structure.

In accordance with an exemplary embodiment of the invention, the base material for the legs 22, 24 can be selected from the group of metals, ceramics, and composites, as well as combinations thereof, and the moldable material for the overmolding can be selected from the group of plastics, thermoplastics, composites, and elastomers, as well as combinations thereof. However, it will be understood that other materials for the legs and moldable material can be used without departing from the spirit and scope of the broader aspects of the invention.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. For example, although the openings are shown as extending through the thickness of the legs, it will be understood that the openings can be in the form of depressions or the like that do not extend entirely through the legs. It will be understood, therefore, that the present invention is not limited to the particular embodiments disclosed, but also covers modifications within the spirit and scope of the invention as defined by the appended claims.

What is claimed is:

1. A bow stand for connecting to opposite sides of a structure associated with an archery bow, the bow stand comprising:

a first leg having: a first connecting portion adapted for contacting one side of the archery bow structure; and a first support portion extending therefrom for supporting the archery bow on a generally horizontal surface;

a second leg having: a second connecting portion adapted for contacting the opposite side of the archery bow structure; and a second support portion extending therefrom for supporting the archery bow on the surface;

the first and second legs being pivotally connected together for rotational movement between a closed position wherein the first and second connecting portions engage the opposite sides of the archery bow structure to thereby support the archery bow on the generally horizontal surface, and an open position wherein the first and second connecting portions are disengaged from the archery bow structure;

each of the first and second connecting portions comprising a front connecting wall and a rear connecting wall spaced from each other to thereby define a hollow interior;

a pivot joint for pivotally connecting the first and second legs together, the pivot joint comprising:

a first pivot joint portion pivotally connecting one of the connecting walls of the first connecting portion with one of the connecting walls of the second connecting portion, and a second pivot joint portion spaced from the first pivot joint portion and pivotally connecting another of the connecting walls of the first connecting portion with another of the connecting walls of the second connecting portion; and a biasing member located in the hollow interior and connected between the first and second connecting portions to alternatively bias the legs toward the closed position and the open position, such that pivoting movement of the legs between the closed and open positions causes the biasing member to travel unobstructed between the first and second pivot joint portions within the hollow interior.

2. A bow stand according to claim 1, wherein the biasing member comprises a coiled tension spring to alternately bias the first and second legs toward the open position and the closed position.

3. A bow stand according to claim 1, wherein the first and second legs are identical in construction, with the first and second legs pivotally connected together in reverse order such that:

the front connecting wall of the first leg abuts the rear connecting wall of the second leg to form a first pair of abutting walls; and the rear connecting wall of the first leg abuts the front connecting wall of the second leg to form a second pair of abutting walls.

4. A bow stand according to claim 3, wherein the pivot joint further comprises:

a first opening extending through the front connecting wall of each leg;

a second opening extending through the rear connecting wall of each leg;

a first fastener extending through the first opening of the front connecting wall of the first leg and the second opening of the abutting rear connecting wall of the second leg to thereby define the first pivot joint portion and pivotally connect the first pair of abutting walls together;

a second fastener extending through the front connecting wall of the second leg and the second opening of the abutting rear connecting wall of the first leg to thereby define the second pivot joint portion and pivotally connect the second pair of abutting walls together;

wherein the first and second pairs of abutting walls and the respective first and second fasteners form the gap within the hollow interior through which the biasing member can travel during pivoting movement of the first and second legs between the open and closed positions.

5. A bow stand according to claim 1, wherein each of the first and second connecting portions comprises:

a pivot section including the pivot joint for pivotally connecting the first and second legs together; and a jaw section extending upwardly from the pivot section, each jaw section including a base segment, a side segment extending from the base segment, and a finger segment extending from the side segment so that the finger segment is cantilevered over the base segment to thereby define an open gap therebetween for receiving the archery bow structure.

6. A bow stand according to claim 5, and further comprising a resilient clamp cover extending around inner surfaces of the base segment, the side wall segment, and the finger segment of the first and second legs.

7. A bow stand according to claim 1, and further comprising a first bumper extending inwardly from the first leg for contacting the second leg when the bow stand is in the closed position.

8. A bow stand according to claim 7, and further comprising a second bumper extending inwardly from the second leg for contacting the first bumper when the bow stand is in the closed position.

9. A bow stand for connecting to opposite sides of a structure associated with an archery bow, the bow stand comprising:

a first leg having: a first connecting portion adapted for contacting one side of the archery bow structure; and a first support portion extending therefrom for supporting the archery bow on a generally horizontal surface;

a second leg having: a second connecting portion adapted for contacting the opposite side of the archery bow structure; and a second support portion extending therefrom for supporting the archery bow on the surface;

the first and second legs being pivotally connected together for rotational movement between a closed position wherein the first and second connecting portions engage the opposite sides of the archery bow structure to thereby support the archery bow on the generally horizontal surface, and an open position wherein the first and second connecting portions are disengaged from the archery bow structure;

the first and second connecting portions together forming a hollow interior;

a biasing member located in the hollow interior and connected between the first and second connecting portions to alternatively bias the legs toward the closed position and the open position;

a first bumper extending inwardly from the first leg for contacting the second leg when the bow stand is in the closed position a second bumper extending inwardly from the second leg for contacting the first bumper when the bow stand is in the closed position;

wherein the first and second bumpers are sized to receive the finger or thumb of a user to facilitate rotating the first and second legs between the open and closed positions.

10. A bow stand according to claim 9, wherein the first and second bumpers are convex in shape.

11. A bow stand according to claim 10, and further comprising a resilient bumper cover extending over the first and second bumpers to cushion and silence the first and second legs when rotated to the closed position.

12. A bow stand according to claim 10, and further comprising an opening formed in each leg adjacent to each bumper to facilitate grasping the bumper by a user.

13. A bow stand according to claim 1, wherein the first and second legs are identical in construction.

14. A bow stand for connecting to opposite sides of a structure associated with an archery bow, the bow stand comprising:

a first leg having a first connecting portion adapted for contacting one side of the archery bow structure and a first support portion extending therefrom for supporting the archery bow on a generally horizontal surface;

a second leg having a second connecting portion adapted for contacting the opposite side of the archery bow structure, and a second support portion extending therefrom for supporting the archery bow on the surface;

the first and second legs being pivotally connected together for rotational movement between a closed position wherein the first and second connecting portions contact the opposite sides of the archery bow structure to thereby support the archery bow on the generally horizontal surface, and an open position wherein the first and second connecting portions are disengaged from the archery bow structure;

each of the first and second connecting portions comprising a front connecting wall and a rear connecting wall spaced from the front connecting wall to form a hollow interior;

the first and second legs being pivotally connected together in reverse order at first and second pivot joint portions such that:

the front connecting wall of the first leg abuts the rear connecting wall of the second leg to form a first pair of abutting walls pivotally connected together at the first pivot joint portion;

the rear connecting wall of the first leg abuts the front connecting wall of the second leg to form a second pair of abutting walls pivotally connected together at the second pivot joint portion;

a gap formed between the first and second pairs of abutting walls; and a biasing member extending between the first and second legs within the hollow interior and movable between an upper biasing position to thereby bias the legs toward the closed position and a lower biasing position to thereby bias the legs toward the open position;

wherein the biasing member passes between the first and second pivot joint portions during movement between the upper and lower biasing positions.

15. A bow stand according to claim 14, wherein the biasing member comprises a coiled tension spring connected between the first and second connecting portions of the first and second legs.

16. A bow stand according to claim 14, wherein each pivot joint portion comprises:

a first opening extending through the front connecting wall of each leg;

a second opening extending through the rear connecting wall of each leg;

a first fastener extending through the first opening of the front connecting wall of the first leg and the second opening of the abutting rear connecting wall of the second leg to thereby pivotally connect the first pair of abutting walls together;

a second fastener extending through the front connecting wall of the second leg and the second opening of the abutting rear connecting wall of the first leg to thereby connect the second pair of abutting walls together;

wherein the first and second pairs of abutting walls and the respective first and second fasteners form a gap through which the biasing member can travel during pivoting movement of the first and second legs between the open and closed positions.

17. A bow stand according to claim 14, wherein each of the first and second connecting portions comprises:

a jaw section spaced above the pivot joint, each jaw section including a base segment, a side segment extending from the base segment, and a finger segment extending from the side segment so that the finger segment is cantilevered over the base segment to thereby define an open gap therebetween for receiving the archery bow structure; and a resilient clamp cover extending around inner surfaces of the base segment, the side wall segment, and the finger segment of the first and second legs.

18. A bow stand for connecting to opposite sides of a structure associated with an archery bow, the bow stand comprising:

a first leg having a first connecting portion adapted for contacting one side of the archery bow structure and a first support portion extending therefrom for supporting the archery bow on a generally horizontal surface;

a second leg having a second connecting portion adapted for contacting the opposite side of the archery bow structure, and a second support portion extending therefrom for supporting the archery bow on the surface;

the first and second legs being pivotally connected together for rotational movement between a closed position wherein the first and second connecting portions contact the opposite sides of the archery bow structure to thereby support the archery bow on the generally horizontal surface, and an open position wherein the first and second connecting portions are disengaged from the archery bow structure;

each of the first and second connecting portions comprising a front connecting wall and a rear spaced from the front connecting wall;

the first and second legs being pivotally connected together in reverse order such that:

the front connecting wall of the first leg abuts the rear connecting wall of the second leg to form a first pair of abutting walls;

the rear connecting wall of the first leg abuts the front connecting wall of the second leg to form a second pair of abutting walls a first bumper extending inwardly from the first leg; and a second bumper extending inwardly from the second leg for contacting the first bumper when the bow stand is in the closed position;

wherein the first and second bumpers are sized to receive the finger or thumb of a user to facilitate rotating the first and second legs between the open and closed positions.

19. A bow stand according to claim 18, and further comprising a resilient bumper cover extending over the first and second bumpers to cushion and silence the first and second legs when rotated to the closed position.

20. A bow stand according to claim 18, and further comprising an opening formed in each leg adjacent to each bumper to facilitate grasping the bumper by a user.

21. A bow stand for connecting to opposite sides of a structure associated with an archery bow, the bow stand comprising:

a first leg having a first connecting portion adapted for contacting one side of the archery bow structure and a first support portion extending therefrom for supporting the archery bow on a surface;

a second leg having a second connecting portion adapted for contacting the opposite side of the archery bow structure, and a second support portion extending therefrom for supporting the archery bow on the surface;

a pivot joint for pivotally connecting the first and second legs together for rotational movement between a closed position for clamping the archery bow structure, and an open position for disengaging the archery bow structure, the pivot joint comprising a first pivot joint portion pivotally joining the first and second legs together at a first location and a second pivot joint portion pivotally joining the first and second legs together at a second location spaced from the first location; and a gap formed between the first and second pivot joint portions;

a biasing member extending between the first and second legs and being translatable through the gap between an upper position for biasing the legs toward the closed position and a lower position for biasing the legs toward the open position during rotational movement of the first and second legs between the closed and open positions.

22. A bow stand according to claim 21, wherein each of the first and second connecting portions comprises:

a jaw section including a base segment, a side segment extending from the base segment, and a finger segment extending from the side segment so that the finger segment is cantilevered over the base segment to thereby define an open gap therebetween for receiving the archery bow structure; and a resilient clamp cover extending around inner surfaces of the base segment, the side segment, and the finger segment of the first and second legs, the resilient clamp cover being overmolded on the jaw section to form an integral structure with the jaw section.

23. A bow stand according to claim 22, wherein the jaw section and the resilient clamp cover comprise mutually engaging surfaces for retaining the clamp cover on the jaw section.

24. A bow stand for connecting to opposite sides of a structure associated with an archery bow, the bow stand comprising:

a first leg having a first connecting portion adapted for contacting one side of the archery bow structure and a first support portion extending therefrom for supporting the archery bow on a generally horizontal surface;

a second leg having a second connecting portion adapted for contacting the opposite side of the archery bow structure, and a second support portion extending therefrom for supporting the archery bow on the surface;

the first and second legs being pivotally connected together for rotational movement between a closed position wherein the first and second connecting portions contact the opposite sides of the archery bow structure to thereby support the archery bow on the generally horizontal surface, and an open position wherein the first and second connecting portions are disengaged from the archery bow structure;

each of the first and second connecting portions comprising:

a jaw section including a base segment, a side segment extending from the base segment, and a finger segment extending from the side segment so that the finger segment is cantilevered over the base segment to thereby define an open gap therebetween for receiving the archery bow structure; and a resilient clamp cover extending around inner surfaces of the base segment, the side segment, and the finger segment of the first and second legs, the resilient clamp cover being overmolded on the jaw section to form an integral structure with the jaw section, with the jaw section and the resilient clamp cover comprising mutually engaging surfaces for retaining the clamp cover on the jaw section; and wherein the mutually engaging surfaces comprise a projection formed on one of the jaw section and the clamp cover, and a complementary-shaped groove formed on the other of the jaw section and the clamp cover.

25. A bow stand for connecting to opposite sides of a structure associated with an archery bow, the bow stand comprising:

a first leg having a first connecting portion adapted for contacting one side of the archery bow structure and a first support portion extending therefrom for supporting the archery bow on a generally horizontal surface;

a second leg having a second connecting portion adapted for contacting the opposite side of the archery bow structure, and a second support portion extending therefrom for supporting the archery bow on the surface;

the first and second legs being pivotally connected together for rotational movement between a closed position wherein the first and second connecting portions contact the opposite sides of the archery bow structure to thereby support the archery bow on the generally horizontal surface, and an open position wherein the first and second connecting portions are disengaged from the archery bow structure;

each of the first and second connecting portions comprising:

a jaw section including a base segment, a side segment extending from the base segment, and a finger segment extending from the side segment so that the finger segment is cantilevered over the base segment to thereby define an open gap therebetween for receiving the archery bow structure; and a resilient clamp cover extending around inner surfaces of the base segment, the side segment, and the finger segment of the first and second legs a first bumper extending inwardly from the first leg;

a second bumper extending inwardly from the second leg for contacting the first bumper when the bow stand is in the closed position;

wherein the first and second bumpers are sized to receive the finger or thumb of a user to facilitate rotating the first and second legs between the open and closed positions; and a resilient bumper cover extending over the first and second bumpers to cushion and silence the first and second legs when rotated to the closed position.

26. A bow stand according to claim 25, wherein the resilient bumper cover is overmolded on each bumper to form an integral structure between the resilient bumper cover and the bumper.

* * * * *